United States Patent [19]

Hinzmann

[11] 4,090,826

[45] May 23, 1978

[54] METHOD AND APPARATUS FOR PERFORATING THE WRAPPERS OF ROD-SHAPED SMOKERS PRODUCTS

[75] Inventor: Alfred Hinzmann, Richmond, Va.

[73] Assignee: Hauni-Werke Korber & Co. KG, Hamburg, Germany

[21] Appl. No.: 735,166

[22] Filed: Oct. 26, 1976

[51] Int. Cl.[2] ..... A24C 5/30; A24F 13/00

[52] U.S. Cl. ..... 131/23 R; 131/170 R

[58] Field of Search ..... 131/170, 23 R, 88, 94, 131/253, 254

[56] References Cited

U.S. PATENT DOCUMENTS

| | | | |
|---|---|---|---|
| 1,740,606 | 12/1929 | Knudsen | 131/170 R |
| 2,694,399 | 11/1954 | Parker et al. | 131/170 R |
| 3,483,873 | 12/1969 | Hinzmann | 131/170 X |
| 3,701,353 | 10/1972 | Pasquine et al. | 131/170 R X |

*Primary Examiner*—Stephen C. Pellegrino
*Attorney, Agent, or Firm*—Peter K. Kontler

[57] ABSTRACT

Apparatus for perforating the wrappers of filter plugs of filter cigarettes has a drum-shaped conveyor which transports filter cigarettes sideways past a stationary housing having a counter-surface defining with the periphery of the conveyor a gap of a width less than the diameter of a cigarette so that the cigarettes are caused to roll during travel through the gap. Tapered needle-like perforating elements are mounted on a carrier in the housing and are movable toward or away from the periphery of the conveyor to thereby increase or reduce the size of holes which are formed by the perforating elements in the wrappers of filter plugs while the respective cigarettes roll during travel through the gap. Alternatively, a first group of perforating elements is mounted on the housing at a fixed distance from the conveyor to perforate each and every filter plug, and one or more additional perforating elements are mounted on the carrier. The carrier is adjustable to move the additional perforating element or elements into the path of movement of successive filter plugs.

19 Claims, 4 Drawing Figures

METHOD AND APPARATUS FOR PERFORATING THE WRAPPERS OF ROD-SHAPED SMOKERS PRODUCTS

BACKGROUND OF THE INVENTION

The present invention relates to improvements in a method and apparatus for making holes in the wrappers of rod-shaped smokers' products, for example, in the wrappers of filter plugs in filter cigarettes, cigarillos or cigars.

It is already known to perforate to wrappers of rod-shaped smokers' products in order to insure that cool atmospheric air will be mixed with hot tobacco smoke which flows from the lighted end of a smokers' product (hereinafter called cigarette or filter cigarette with the understanding, however, that smokers' products which can be treated in accordance with the method and in the apparatus of the present invention may also constitute plain or filter tipped cigars, cigarillos, cheroots as well as cigarettes of the type known as papyrossi). The admission of atmospheric air into the stream of hot tobacco smoke is desirable and advantageous because cool atmospheric air can influence the nicotine and condensate contents of tobacco smoke. However, the wrappers of cigarettes cannot be perforated at random, i.e., it is desirable to provide an apparatus which is capable of insuring that each and every cigarette will admit identical quantities of atmospheric air as well as that the apparatus will allow for adjustment of permeability of the wrappers, e.g., when a manufacturer wishes to change the quantity of inflowing air and/or when the permeability of cigarette wrappers exceeds or is less than an optimum permeability. Heretofore known perforating apparatus cannot meet such requirements.

OBJECT AND SUMMARY OF THE INVENTION

An object of the invention is to provide a novel and improved method of perforating the wrappers of rod-shaped smokers' products, especially cigarettes, in such a way that the permeability of wrappers invariably matches or closely approximates an optimum permeability.

Another object of the invention is to provide a novel apparatus which can be used for the practice of the improved method and which is constructed and assembled in such a way that it can be readily installed in existing machines for the production of rodshaped smokers' products, e.g., in the makers of plain or filter cigarettes.

A further object of the invention is to provide a perforating apparatus which can be adjusted while the maker is in actual use and which is sufficiently compact to be readily accommodated in existing makers of cigarettes or the like without appreciable modifications of such machines.

An additional object of the invention is to provide a perforating apparatus which is especially suited for the making of holes in the wrappers of filter plugs which are assembled with rodshaped tobacco-containing components to form therewith filter cigarettes, cigars or cigarillos.

Still another object of the invention is to provide the apparatus with novel and improved perforating means and with novel and improved means for changing the positions of at least some perforating means relative to the wrappers of plain or filter-tipped cigarettes or the like.

A further object of the invention is to provide a perforating apparatus which, in addition to its primary function, also performs at least one additional important and advantageous function as an adjunct to the making of holes in the wrappers of rod-shaped smokers' products.

Another object of the invention is to provide a perforating apparatus which can be designed to provide the wrappers of rodshaped smokers' products with holes of desired size and/or shape as well as with a selected number of holes.

One feature of the invention resides in the provision of an apparatus for perforating the wrappers of cigarettes or analogous rod-shaped articles having predetermined diameters and constituting or forming part of rod-shaped smokers' products, for example, for perforating the wrappers of filter plugs which form part of filter-tipped cigarettes. The apparatus comprises a preferably drum-shaped rotary conveyor member having a first surface (this surface is a convex cylindrical surface if the conveyor member is a drum) arranged to support (e.g., by suction) and advance a series of successive rod-shaped articles sideways along a predetermined path, a conveyor or other suitable means for feeding articles into the path, a second member having a second surface which is adjacent to a portion of the path and defines with the first surface a gap whose width at most equals the diameter of a rod-shaped article so that each article which enters the gap is caused to roll about its own axis during travel through the gap, a plurality of needle-like perforating elements mounted in or on one of the members and extending or extendable beyond the surface of the one member to penetrate into and to thereby perforate the wrappers of articles which roll in the gap between the first and second surfaces, and means for moving at least some of the perforating elements with respect to the two surfaces to thereby vary the size and/or the number of perforations in the wrappers of articles.

The one member is preferably the second member, and the means for moving the perforating elements may be actuated by hand.

Another feature of the invention resides in the provision of a method of treating the wrappers of rod-shaped articles which constitute or form part of smokers' products, e.g., of treating the wrappers of filter plugs in filter cigarettes. The method comprises the steps of conveying a succession of articles sideways along a predetermined path (e.g., on the periphery of a rotary drum-shaped conveyor), rolling successive articles about their respective axes during transport along a predetermined portion of the path (e.g., in a gap between the aforementioned conveyor and a stationary member), making holes in the wrappers of articles in the aforementioned portion of the path (e.g., by resorting to tapered needle-like perforating elements which are mounted in the conveyor and/or in the stationary member), and increasing or reducing the size and/or the number of holes to thereby change the permeability of the wrappers.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
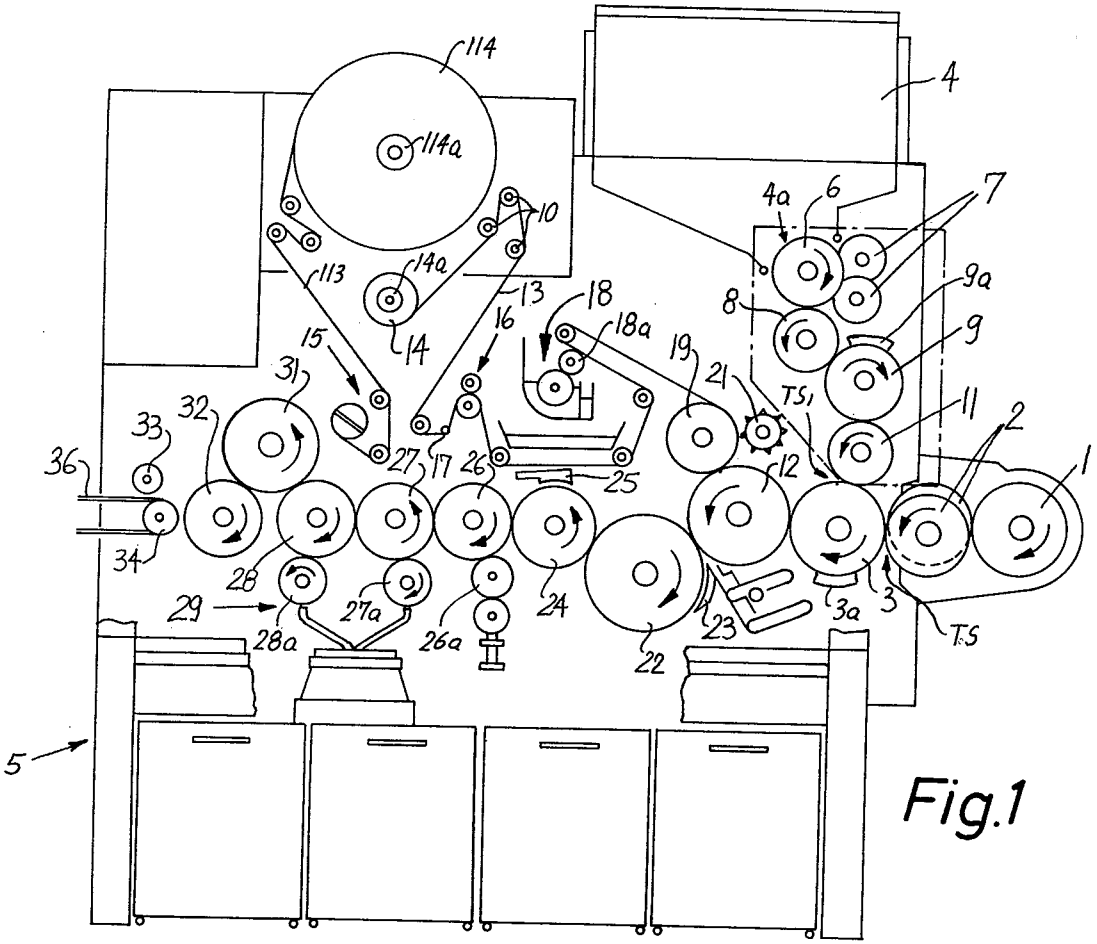
FIG. 1 is a schematic elevational view of a filter cigarette making machine including a perforating apparatus which embodies the invention.

FIG. 1 shows a filter cigarette making machine of the type known as MAX S (trademark) which is produced by Hauni-Werke Korber & Co. KG, Hamburg-Bergedorf, Federal Republic Germany. The machine comprises a frame 5 supporting two drum-shaped aligning conveyors 2 which are provided with peripheral flutes serving to receive discrete plain cigarettes of unit length from the flutes of a rotary drum-shaped row forming conveyor 1. The latter is mounted in the frame 5 but can be said to form part of a cigarette making machine, e.g., a machine known as GARANT (trademark) and also produced by the Hauni-Werke. The conveyor 1 forms two rows of plain cigarettes, with the cigarettes of one row located in oddly numbered flutes and the cigarettes of the other row located in evenly numbered flutes. The cigarettes of the one row are nearer to one axial end of the conveyor 1 and are transferred into successive flutes of one aligning conveyor 2, and the cigarettes of the other row are nearer to the other axial end of the conveyor 1 and are transferred into successive flutes of the other aligning conveyor 2. The conveyors 2 are driven at different speeds and/or transport the respective plain cigarettes through different distances so that each cigarette of one row registers with a cigarette of the other row when such cigarettes reach a transfer station TS between the conveyors 2 and a rotary drum-shaped assembly conveyor 3 in the frame 5. The plain cigarettes which enter a flute of the assembly conveyor 3 are spaced apart, i.e., they define a clearance having a width which at least equals but preferably at least slightly exceeds the length of a filter rod section or filter plug of double unit length.

The upper portion of the frame 5 supports a magazine or hopper 4 for a supply of filter rod sections (not shown) of 6 times unit length. The outlet 4a of the magazine 4 receives a portion of a fluted rotary drum-shaped severing conveyor 6 which is driven to rotate in the direction indicated by arrow and transports a row of filter rod sections sideways past two rotary disk-shaped knives 7 which subdivide each filter rod section into a group of three coaxial filter rod sections or filter plugs of double unit length. Such groups are accepted by three rotary drum-shaped elements of a staggering conveyor 8 (only one drum-shaped element is shown) which are driven at different speeds and/or transport the respective filter plugs through different distances so that the filter plugs of each group are staggered circumferentially of the illustrated drum-shaped element. Successive filter plugs are introduced into successive flutes of a rotary drum-shaped shuffling conveyor 9 which cooperates with two stationary cams 9a to convert the filter plugs into a single row wherein each preceding plug is in exact alinement with the next-following plug. The shuffling conveyor 9 transfers successive filter plugs into successive flutes of a rapidly rotating drum-shaped inserting conveyor 11 which introduces successive filter plugs into successive flutes of the assembly conveyor 3 at a transfer station $TS_1$ which is located ahead of the station TS, as considered in the direction of rotation of the assembly conveyor. The filter plugs enter those portions of successive flutes at the periphery of the assembly conveyor 3 which are flanked by pairs of plain cigarettes downstream of the transfer station TS. The assembly conveyor 3 transports successive groups of rod-shaped articles (each such group includes two plain cigarettes of unit length and a filter rod section or filter plug of double unit length therebetween) past two condensing cams 3a (only one shown) which cause the cigarettes to move axially into abutment with the respective end faces of the associated filter plug. Such groups are thereupon introduced into successive flutes of a rotary drum-shaped transfer conveyor 12.

The frame 5 further supports a spindle 14a for a roll 14 of wrapping material, e.g., a web 13 of imitation cork or the like. The web 13 is trained over several guide rolls 10 and is advanced by two rolls 16 one of which is driven and the other of which is biased against the one roll. Prior to reaching the nip of the advancing rolls 16, successive increments of the web 13 are caused to pass along the relatively sharp edge of a curling device 17 which eliminates or reduces variations of internal stresses in the material of the web 13. A suitable curling device is disclosed in the commonly owned U.S. Pat. No. 3,962,957 granted June 15, 1976 to Hinzmann. One side of the web 13 is thereupon coated with a suitable adhesive during travel along the roller-shaped applicator 18a of a paster 18. The leader of the web 13 is attracted to the periphery of a rotary suction drum 19 which cooperates with one or more knives of a rotary drum-shaped knife holder 21 to sever the leader of the web 13 at regular intervals so that the web yields a succession of adhesive-coated uniting bands which are attached to successive groups of rod-shaped articles in the flutes of the transfer conveyor 12. Each uniting band is attached to the corresponding group in such a way that it extends tangentially of the group and adheres to the filter plug as well as to the inner end portions of the corresponding plain cigarettes of unit length.

The frame 5 further supports a second spindle 114a for a roll 114 of a second web 113 whose leader is held in a position of readiness at a splicing station 15 so that it can be attached to the running web 13 when the roll 14 is nearly exhausted. The construction of splicing mechanism which unites the webs 13 and 113, preferably in response to a signal from a detector which monitors the diameter of the expiring roll 14, forms no part of the invention.

The transfer conveyor 12 delivers successive groups of rod-shaped articles (each group carries a uniting band) to a rotary drum-shaped wrapping conveyor 22 which cooperates with a stationary or mobile rolling device 23 to rotate successive groups about their respective axes and to thereby convert each uniting band into a tube which connects the corresponding filter plug to the adjacent end portions of the associated plain cigarettes. Thus, the conveyor 22 cooperates with the rolling device 23 to convert each group of rodshaped articles and the corresponding uniting band into a filter cigarette 39 (see FIGS. 2 and 3) of double unit length.

Figure 2:
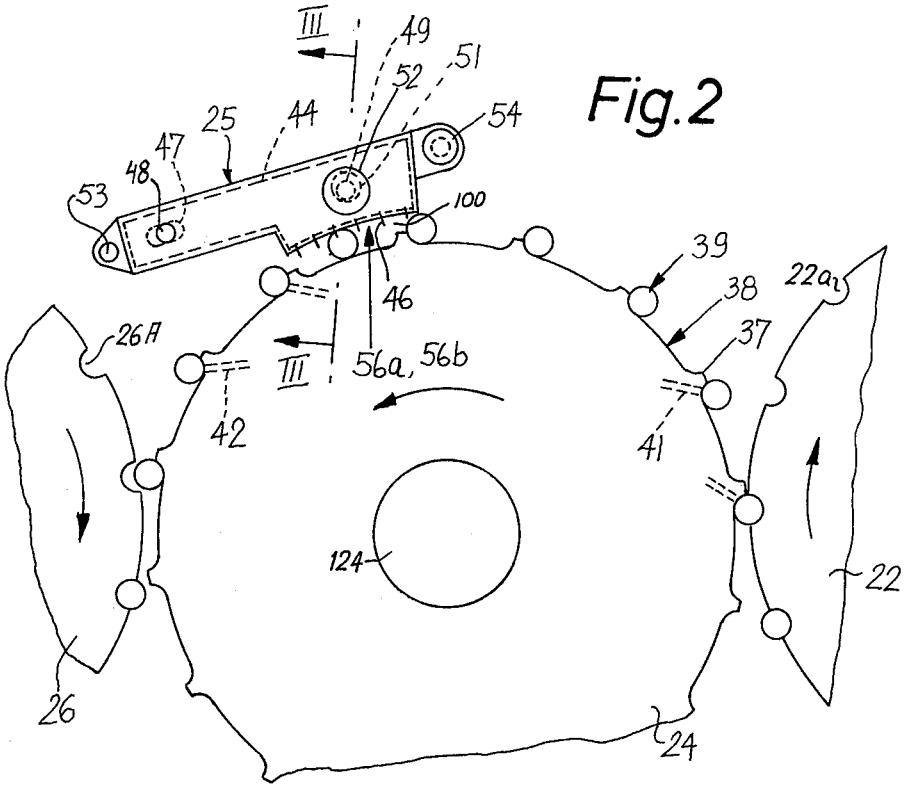
FIG. 2 is an enlarged elevational view of the perforating apparatus.
Figure 3:
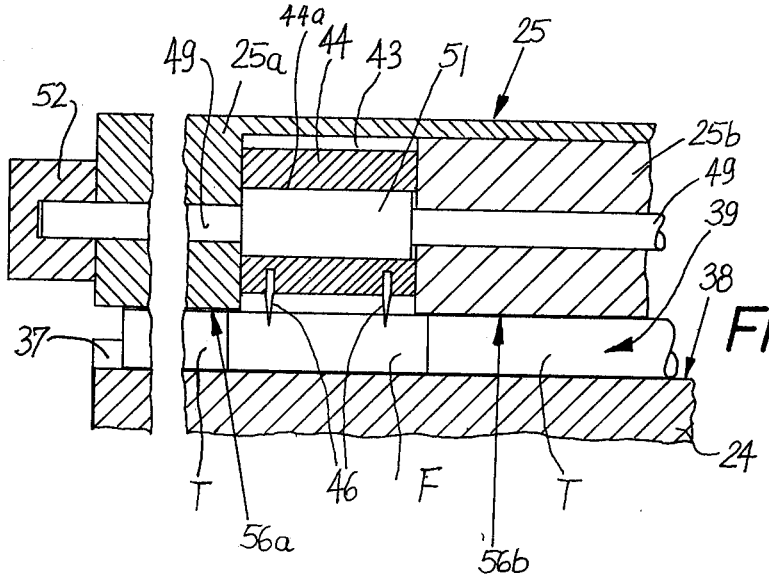
FIG. 3 is an enlarged transverse sectional view as seen in the direction of arrows from the line III—III of FIG. 2.

Successive filter cigarettes 39 of double unit length are transferred onto a further rotary drum-shaped conveyor 24 which constitutes a first member of the improved perforating apparatus and the details of which are shown in FIGS. 2 and 3. The conveyor 24 transports successive filter cigarettes 39 of double unit length past a second member 25 of the perforating apparatus. The detials of the second member 25 are shown in FIGS. 2 and 3. The conveyor 24 is continuously driven by the prime mover of the filter cigarette making machine through the medium of a shaft 124.

The conveyor 24 thereupon delivers filter cigarettes 39 of double unit length into successive flutes of a rotary drum-shaped severing conveyor 26 which cooperates with a rotary disk-shaped knife 26*a* to subdivide each filter cigarette 39 into two coaxial filter cigarettes of unit length. Successive pairs of aligned filter cigarettes of unit length are thereupon introduced into successive flutes of a rotary drum-shaped conveyor 27 forming part of a turn-around device 29 of the type disclosed in commonly owned U.S. Pat. No. 3,583,546 granted June 8, 1971 to Koop. The turn-around device 29 further comprises rotary drum-shaped conveyors 27*a*, 28 and 28*a* the latter of which transports a single row of filter cigarettes of unit length toward and into successive flutes of a rotary drum-shaped conveyor 31. The purpose of the turn-around device 29 is to invert one filter cigarette of each pair end-for-end so that the filter plugs of all filter cigarettes of unit length face in the same direction before such cigarettes reach the conveyor 31.

The severing conveyor 26 preferably forms part of a testing unit having means for monitoring the wrappers of filter cigarettes 39 of double unit length for the presence of open seams, holes, ragged ends or other defects. Filter cigarettes 39 with defective wrappers are segregated from other filter cigarettes of double unit length.

The conveyor 31 delivers satisfactory filter cigarettes of unit length to a rotary drum-shaped conveyor 32 which transfers such cigarettes onto the upper reach of an endless conveyor belt 36 trained over pulleys 34 (one shown) and serving to advance a single row of filter cigarettes of unit length to storage, to a tray filling apparatus or directly into a packing machine, not shown. The illustrated pulley 34 cooperates with a rotary braking drum 33 for filter cigarettes of unit length.

FIGS. 2 and 3 show the details of the perforating apparatus. The conveyor 24 has ribs or projections 37 which alternate with convex rolling facets 38 forming part of the cylindrical peripheral surface of the conveyor 24. The direction of rotation of the conveyor 24 is indicated by an arrow. The body of the conveyor 24 has suction ports 41 which communicate with the rolling facets 38 upstream of each rib 37 and suction ports 42 which communicate with the rolling facets 38 downstream of each rib 37. The conveyor 22 delivers filter cigarettes 39 of double unit length in such a way that each cigarette 39 is attracted by a suction port 41 immediately upstream of the neighboring rib 37. It is clear that the body of the conveyor 24 can be provided with rows of suction ports 41 and 42, i.e., with two or more suction ports 41 upstream of each rib 37 and with two or more suction ports 42 downstream of each rib. The manner in which the suction ports 41, 42 are connected with a suction generating device (e.g., a suction fan, not shown) while the corresponding ribs 37 travel from the transfer station between the conveyors 22, 24 to the transfer station between the conveyors 24, 26 is known from the art of machines for the transport and processing of rod-shaped smokers' products. As a rule, the body of the conveyor 24 will be formed with blind bores which are parallel to the axis of the conveyor 24 and communicate with the arcuate groove of a stationary valve plate which is adjacent to one end face of the conveyor 24. The groove of the valve plate is connected with the suction intake of a fan or the like.

The length of each rolling facet 38 (as considered in the circumferential direction of the conveyor 24) at least equals the circumference of a filter cigarette 39 of double unit length. The reference characters T denote the plain cigarettes and the reference character F denotes the filter plug of the filter cigarette 39 which is shown in FIG. 3.

The second member 25 of the perforating apparatus comprises a first portion or housing having two sections 25i a, 25*b* which define a compartment 43 for a second portion 44 of the member 25. The portion 44 constitutes a carrier for needle-like perforating elements 46. The carrier 44 has an elongated slot 47 (indicated in FIG. 2 by broken lines) which receives a guide pin 48 of the housing 25*a*, 25*b*. The pin 48 allows the carrier 44 to pivot relative to the housing 25*a*, 25*b* as well as to move lengthwise of the compartment 43. The slot 47 is adjacent to one end portion of the carrier 44, and the other end portion of the carrier has a transverse cylindrical bore 44*a* for a cylindrical eccentric 51 on a moving shaft 49 which is turnable back and forth by a handgrip member 52, e.g., a knob which is accessible at the outer side of the housing 25*a*, 25*b*. The shaft 49 is journalled in the housing section 25*a*. The housing 25*a*, 25*b* is pivotable on a pin 53 which is mounted in or on the frame 5 (not shown in FIGS. 2 and 3) so that the entire member 25 can be pivoted (anticlockwise) away from the operative position of FIG. 2 or (clockwise) toward such operative position. A bolt 54 or other suitable means is provided for locking the member 25 in the operative position of FIG. 2. If the attendant wishes to pivot the member 25 to an inoperative position, e.g., to gain access to the exposed portions of the perforating elements 46, the bolt 54 is removed from its socket in the frame 5 and the member 25 is pivoted anticlockwise, as viewed in FIG. 2.

The operative position of the member 25 is selected in such a way that, when the bolt 54 extends into the aforementioned socket of the frame 5, the width of the elongated gap 100 between the adjacent rolling facet 38 and the concave countersurfaces 56*a*, 56*b* of the housing sections 25*a*, 25*b* is slightly less than the diameter of a filter cigarette 39 of double unit length. Thus, when a cigarette 39 reaches the perforating station between the conveyor 24 and member 25, it is caused to roll about its own axis because it is engaged by the corresponding rolling facet 38 as well as by the countersurfaces 56*a*, 56*b*. This causes the cigarette 39 to roll backwards, i.e., from the rib 37 at the front end toward the rib 37 at the rear end of the respective rolling facet 38. The center of curvature of concave countersurfaces 56*a*, 56*b* is located on the axis of the shaft 124, the same as the centers of curvature of the convex facets 38. The perforating elements 46 form two rows which extend circumferentially of the conveyor 24 and are in register with the filter plugs F of successive filter cigarettes 39 of double unit length. The holes or perforations which are made by the elements 46 are preferably adjacent to the respective end portions of the filter plugs F, i.e., close to the locations where the filter plugs F abut against the inner ends of the respective plain cigarettes T.

In accordance with a slight modification which is not shown in the drawing, the illustrated conveyor 24 can be replaced with a conveyor having relatively shallow peripheral flutes and the member 25 can be replaced with a unit which is longer (as considered in the circumferential direction of the associated conveyor) so that each cigarette 39 is caused to roll several times about its own axis during travel through the gap between the conveyor and the unit. The latter is then preferably provided with one or more additional rows of needles or analogous perforating elements which make holes in successive filter plugs F in regions other than those which are preforated by the illustrated elements 46. For example, the arrangement may be such that each cigarette 39 is caused to complete two full revolutions about its own axis and the unit may comprise four rows of needle-like perforating elements which may but need not perforate the corresponding portions of successive plugs F at the same time, i.e., one or more rows can perforate successive filter plugs F during a first stage of movement of each filter plug between the conveyor and the aforementioned unit and the other row or rows may perforate successive filter plugs F during the next-following stage or stages of such movement.

The facets 38 together constitute a first surface at one side of the gap 100 and the countersurfaces 56*a*, 56*b* together constitute a second surface at the other side of the gap 100 opposite that facet (or those facets) 38 which travels (or travel) below the member 25.

The operation of the perforating apparatus including the conveyor 24 and member 25 is as follows:

The flutes 22*a* of the conveyor 22 feed filter cigarettes 39 into the elongated path which is defined by the rolling facets 38 of the conveyor 24. Such cigarettes are attracted by the respective suction ports 41 so that they are located immediately behind the preceding ribs 37 and cannot leave the rolling facets 38 under the action of gravity and/or centrifugal force during transport toward the gap 100 between the conveyor 24 and the housing 25*a*, 25*b*. As soon as a cigarette 39 reaches the countersurfaces 56*a*, 56*b*, it begins to roll rearwardly along the corresponding facet 38 because the distance between the facet 38 and countersurfaces 56*a*, 56*b* is less than the diameter of a filter plug F (the diameter of the filter plug normally slightly exceeds the diameters of the plain cigarettes T). Suction in the corresponding port or ports 41 can be terminated as soon as the adjacent cigarette 39 reaches the gap 100. During rolling relative to the adjacent facet 38, the filter plug F of each cigarette 39 is perforated by the two rows of perforating elements 46 whose cross-sectional area preferably decreases in a direction from the carrier 44 toward the periphery of the conveyor 24 (each perforating element 46 may constitute or include a slender conical or pyramidal needle). When a cigarette 39 advances beyond the countersurfaces 56*a*, 56*b*, it is attracted by the corresponding suction port or ports 42 and advances toward the transfer station between the conveyors 24, 26 to enter the oncoming flute 26A.

The attendant will manipulate the knob 52 in order to increase or reduce the diameters of holes which are formed by the perforating elements 46. Thus, by rotating the knob 52 in one direction, the attendant can move the tips of perforating elements 46 away from the periphery of the conveyor 24 to thereby reduce the diameters of holes in the wrapping material of the filter plugs F. On the other hand, the diameters of holes in successive wrappers will be increased if the knob 52 is rotated in a direction to move the tips of perforating elements 46 nearer to the periphery of the conveyor 24. This will be readily appreciated by bearing in mind that the perforating elements 46 taper in a direction from the carrier 44 toward the conveyor 24. The knob 52 also serves as a means for adjusting the positions of perforating elements 46 in order to compensate for wear upon their tips as well as for changes in such unpredictable parameters as the quality of wrapping material which is perforated by the elements 46, the density and hardness of the filter plugs F and/or others.

The bolt 54 will be removed, or at least separated, from the frame 5 when the attendant wishes to inspect the perforating elements 46, to clean the countersurfaces 56*a*, 56*b* or to remove foreign matter from the compartment 43. The perforating elements 46 can be mounted in the carrier 44 in such a way that each thereof is readily removable; this enables the attendant to replace broken or partially broken perforating elements or to replace some or all perforating elements after a certain period of use which is long enough to warrant the assumption that the tips of perforating elements 46 are dull or that the length of perforating elements has been reduced due to extensive wear.

Each row of needle-like perforating elements 46 can be replaced with a serrated metallic or plastic strip having toothed (i.e., tapered) perforating elements.

Instead of using tapering (conical or pyramidal) perforating elements, the apparatus of the present invention can use perforating elements whose cross-sectional area is constant from end to end. The perforating elements are then arranged in several groups so that a single group of elements penetrates into the wrappers of filter plugs F in the gap 100 when the carrier 44 assumes a first position relative to the housing 25*a*, 25*b*, that two groups of perforating elements perforate the wrappers in a second position of the carrier, and so forth. In other words, the permeability of wrappers of the filter plugs can be changed by varying the size of each hole or perforation and/or by varying the number of perforations.

Figure 4:
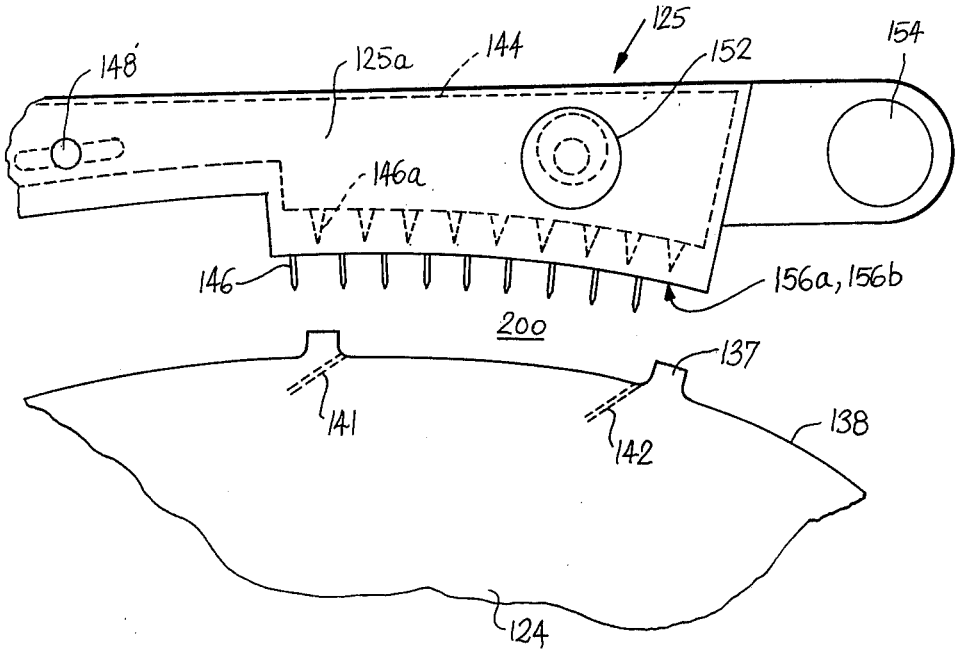
FIG. 4 is an elevational view of a portion of a modified perforating apparatus.

An embodiment which is similar to the just discussed embodiment is shown in FIG. 4 wherein all such parts which are identical with or clearly analogous to the corresponding parts of the first apparatus are denoted by similar reference characters plus 100. The stationary member 125 includes a housing (only the section 125*a* shown) and a carrier 144. The housing supports a first set or group of straight perforating elements 146 each of which has a pointed tip and a main body portion of constant cross-sectional area. The perforating elements 146 extend beyond the countersurfaces 156*a*, 156*b* so that each thereof invariably perforates the wrapper of a filter plug (not shown) in the gap 200. The carrier 144 supports a second set or group of perforating elements 146*a* each of which tapers in a direction from the carrier 144 toward the conveyor 124. The taper of perforating elements 146*a* is desirable but optional.

The carrier 144 is movable (through the medium of the knob 152) between a first position in which the perforating elements 146*a* are retracted to a level above the countersurfaces 156*a*, 156*b* so that they cannot perforate the filter plugs in the gap 200 and at least one second position in which the elements 146*a* extend into the gap 200 and perforate the filter plugs. The extent of angular displacement of the knob 152 determines the extent to which the elements 146a extend downwardly beyond the countersurfaces 156a, 156b.

If the perforating elements 146a do not taper in a direction from the carrier 144 toward the conveyor 124, they may be mounted in the carrier in several groups in such a way none of the elements 146a extend downwardly beyond the countersurfaces 156a, 156b in a first angular position of the carrier 144, that a first group of elements 146a extends beyond the countersurfaces in a second angular position of the knob 152, that two groups of elements 146a extend into the gap 200 in a third angular position of the knob, and so forth. This also enables the apparatus to vary the permeability of the wrappers of filter plugs by varying the number of perforations in response to appropriate adjustment of the carrier 144 relative to the housing of the member 125.

It is further clear that the perforating elements 46 or analogous perforating elements can be movably mounted in the conveyor 24 so as to extend beyond the surface including the facets 38. The apparatus which are shown in FIGS. 2–3 and 4 are preferred at this time because they can operate with a relatively small number of perforating elements and because the means for moving some or all of the perforating elements relative to the surfaces of the conveyor 24 or 124 and housing of the member 25 or 125 are simpler. If the perforating elements are mounted in the conveyor 24 or 124, they can be adjusted in a number of ways, for example, in a manner known from the art of cutoffs for cigarette rod making machines wherein the cutoff comprises a rotary body with one or more knives which extend from the rotary body and whose position relative to the body is adjustable to compensate for wear upon the cutting edges. Reference may be had to the commonly owned U.S. Pat. No. 3,518,911 granted July 7, 1970 to Niemann et al.

An important secondary or ancillary advantage of the improved perforating apparatus is that they further reduce the likelihood of leakage of tobacco smoke (and/or the penetration of air) in regions where the filter plugs F of double unit length are united with the respective plain cigarettes T by adhesive-coated bands. This will be readily understood by referring again to FIG. 1 which shows that the member 25 is adjacent to the conveyor 24, i.e., that it is located downstream of the gap between the wrapping conveyor 22 and rolling device 23. Thus, each uniting band which is converted into a tube during travel in the gap between the parts 22, 23 is subjected to a second rolling action during travel between the respective rolling facet 38 and the countersurfaces 56a, 56b.

In presently known machines, the perforating elements are disposed in the gap between the conveyor 22 and rolling device 23 so that each uniting band is subjected to a single rolling action. The placing of my perforating apparatus 24, 25 or 124, 125 downstream of the conveyor 22 is desirable and advantageous because the rolling action between 22 and 23 (e.g., by moving the member 23 toward of away from the conveyor 22) can be adjusted independently of adjustment of the perforating elements 46 or 146a relative to the conveyor 24 or 124, or vice versa. Furthermore, and as explained above, renewed rolling of uniting bands is desirable because it further reduces the likelihood of uncontrolled leakage of tobacco smoke or uncontrolled penetration of air in the region where the filter plug is connected to the wrapped tobacco filler.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. Apparatus for perforating the wrappers of cigarettes or analogous rod-shaped articles having predetermined diameters and constituting or forming part of rod-shaped smokers' products, comprising a conveyor member having a first surface arranged to support and advance a series of successive articles sideways along a predetermined path; means for feeding articles into said path; a second member having a second surface adjacent to a portion of said path and being separated from said first surface by a gap having a width which at most equals said diameter so that articles which enter said gap are caused to roll during travel with said conveyor member; a plurality of perforating elements mounted in one of said members, at least some of said elements extending beyond the surface of said one member to penetrate into and to thereby perforate the wrappers of articles which roll during travel through said gap; and means for changing the combined area of perforations in said wrappers, including means for moving at least one of said perforating elements with respect to said surfaces between at least two different positions in each of which the articles rolling during travel through said gap are perforated.

2. Apparatus as defined in claim 1, further comprising means for continuously driving said conveyor member, said conveyor member including a rotary drum-shaped portion having a substantially cylindrical surface which constitute said first surface, said second surface being a concave surface and said surfaces having a common center of curvature.

3. Apparatus as defined in claim 1, wherein said conveyor member comprises article retaining means which are operative at least while said first surface advances articles from said feeding means toward said gap.

4. Apparatus as defined in claim 1, wherein said second member is normally stationary and said one member is said second member.

5. Apparatus as defined in claim 1, wherein said second member is movable relative to said conveyor member to and from an operative position in which said surfaces define said gap.

6. Apparatus as defined in claim 1, wherein said perforating elements form at least one row extending in substantial parallelism with the direction of sidewise movement of articles along said path.

7. Apparatus for perforating the wrappers of cigarettes or analogous rod-shaped articles having predetermined diameters and constituting or forming part of rod-shaped smokers' products, comprising a conveyor member having a first surface arranged to support and advance a series of successive articles sideways along a predetermined path; means for feeding articles into said path; a second member including a first portion having a second surface adjacent to a portion of said path and being separated from said first surface by a gap having a width which at most equals said diameter so that articles which enter said gap are caused to roll during travel with said conveyor member, said second member further including a second portion; a plurality of perforating elements supported by said second portion of said second member, said elements extending beyond said second surface toward that portion of said first surface which is adjacent said gap to penetrate into and to thereby perforate the wrappers of articles which roll during travel through said gap; and means for varying the distance between said perforating elements and said portion of said first surface to thereby change the combined area of perforations in said wrappers.

8. Apparatus as defined in claim 7, wherein said distance varying means comprises means for moving said second portion of said second member relative to said first portion of said second member.

9. Apparatus as defined in claim 8, wherein said means for moving said second portion is mounted on said first portion of said second member.

10. Apparatus for perforating the wrappers of cigarettes or analogous rod-shaped articles having predetermined diameters and constituting or forming part of rod-shaped smokers' products, comprising a conveyor member having a first surface arranged to support and advance a series of successive articles sideways along a predetermined path; means for feeding articles into said path; a second member having a second surface adjacent to a portion of said path and being separated from said first surface by a gap having a width which at most equals said diameter so that articles which enter said gap are caused to roll during travel with said conveyor member, said second member being pivotable about a fixed axis relative to said conveyor member to and from an operative position in which said surfaces define said gap; means for releasably locking said second member in said operative position; a plurality of perforating elements mounted in one of said members, at least some of said elements extending beyond the surface of said one member to penetrate into and to thereby perforate the wrappers of articles which roll dring travel through said gap; and means for moving at least some of said perforating elements with respect to said surfaces to thereby change the combined area of perforations in said wrappers.

11. Apparatus for perforating the wrappers of cigarettes or analogous rod-shaped articles having predetermined diameters and constituting or forming part of rod-shaped smokers' products, comprising a conveyor member having a first surface arranged to support and advance a series of successive articles sideways along a predetermined path; means for feeding articles into said path; a second member having a second surface adjacent to a portion of said path and being separated from said first surface by a gap having a width which at most equals said diameter so that articles which enter said gap are caused to roll during travel with said conveyor member; a plurality of perforating elements mounted in one of said members, said elements including at least one group extending beyond the surface of said one member to penetrate into and to thereby perforate the wrappers of articles which roll during travel through said gap, the elements of said one group tapering in a direction from the surface of said one member toward the other of said surfaces; and means for varying the distance between the elements of said group and said other surface so that the size of each perforation formed by the elements of said group increases in response to a reduction of said distance and vice versa.

12. Apparatus as defined in claim 11, wherein the perforating elements of said one group are needles.

13. Apparatus as defined in claim 12, wherein said needles have conical or pyramidal portions which extend beyond the surface of said one member.

14. Apparatus for perforating the wrappers of cigarettes or analogous rod-shaped articles having predetermined diameters and constituting or forming part of rod-shaped smokers' products, comprising a conveyor member having a first surface arranged to support and advance a series of successive articles sideways along a predetermined path; means for feeding articles into said path; a second member including a normally stationary first portion having a second surface adjacent to a portion of said path and being separated from said first surface by a gap having a width which at most equals said diameter so that articles which enter said gap are caused to roll during travel with said conveyor member, said second member further including a second portion which is movable relative to said first portion; a plurality of perforating elements mounted in said second member, at least some of said elements extending beyond the surface of said second member to penetrate into and to thereby perforate the wrappers of articles which roll during travel through said gap, said perforating elements including a first group mounted on said first portion and extending into said gap and a second group mounted on and movable with said second portion between a first and at least one second position to thereby respectively increase and reduce the distance between the elements of said second group and said conveyor member; and means for moving the perforating elments of said second group with respect to said surfaces to thereby change the combined area of perforations in said wrappers.

15. Apparatus as defined in claim 14, wherein the elements of said second group taper in a direction from said second portion toward said conveyor member and said second portion is movable between a plurality of second positions in each of which the elements of said second group extend into said gap to a different extent.

16. Apparatus as defined in claim 14, wherein the elements of said second group respectively extend into and are withdrawn from said gap in said second and first positions thereof.

17. In a machine for assembling filter plugs with wrapped rod-like tobacco fillers by means of adhesive-coated uniting bands, a combination comprising means for assembling successive wrapped fillers with successive filter plugs end-to-end; means for convoluting uniting bands around successive filter plugs and the neighboring portions of the respective wrapped fillers, including means for rolling the filter plugs and the associated wrapped fillers about their respective axes to thus convert the uniting bands into tubes of the resulting filter-tipped smokers' products having predetermined diameters; and apparatus for perforating the tubes and the respective filter plugs, including a conveyor member for moving successive smokers' products sideways along a predetermined path, said conveyor member having a convex surface and means for attracting smokers' products to said surface, a second member having a counter-surface adjacent a portion of said path and defining with said first surface a gap whose width at most equals said predetermined diameter so that successive products entering said gap are caused to roll about their respective axes, a plurality of substantially needle-like perforating elements mounted in one of said members, said elements including at least one group whose elements extend from the respective surface to penetrate into the tubes of successive products during travel of products through said gap, and means for changing the combined area of perforations in said tubes, including means for moving at least one of said elements relative to said surfaces between at least two different positions in each of which at least some of said elements penetrate into the tubes of successive products during travel of products through said gap.

18. A method of treating the wrappers of rod-shaped articles which constitute or form part of smokers' products, comprising the steps of conveying a succession of articles sideways along a predetermined path; rolling successive articles about their respective axes during transport along a predetermined portion of said path; making holes in the wrappers of all articles in said portion of said path; and increasing or reducing the size and/or the number of holes to thereby change the permeability of the wrappers.

19. Apparatus for perforating the wrappers of cigarettes or analogous rod-shaped articles having predetermined diameters and constituting or forming part of rod-shaped smokers' products, comprising a conveyor member having a first surface arranged to support and advance a series of successive articles sideways along a predetermined path; means for feeding articles into said path; a second member having a second surface adjacent to a portion of said path and being separated from said first surface by a gap having a width which at most equals said diameter so that articles which enter said gap are caused to roll during travel with said conveyor member; a plurality of perforating elements mounted in one of said members, said perforating elements including at least one group whose elements extend in a direction from the surface of said one member toward the other of said surfaces to penetrate into and to thereby perforate the wrappers of articles which roll during travel through said gap; and means for varying the distance between the perforating elements of said one group and said other surface to thereby change the combined area of perforations in said wrappers.

* * * * *